US005109324A

United States Patent [19]

Ahroni

[11] Patent Number: 5,109,324

[45] Date of Patent: Apr. 28, 1992

[54] LIGHT UNIT FOR DECORATIVE MINIATURE LIGHT SETS

[76] Inventor: Joseph M. Ahroni, 2701 W. Manor Pl., #204, Seattle, Wash. 98199

[21] Appl. No.: 637,377

[22] Filed: Jan. 4, 1991

Related U.S. Application Data

[63] Continuation-in-part of Ser. No. 461,489, Jan. 5, 1990, abandoned, which is a continuation-in-part of Ser. No. 290,239, Dec. 22, 1988, Pat. No. 4,899,266, which is a continuation-in-part of Ser. No. 131,027, Dec. 10, 1987, Pat. No. 4,807,098, which is a continuation-in-part of Ser. No. 945,602, Dec. 22, 1986, Pat. No. 4,779,177, which is a continuation-in-part of Ser. No. 664,153, Oct. 24, 1984, Pat. No. 4,631,650.

[51] Int. Cl.[5] ..... F21V 21/00

[52] U.S. Cl. ..... 362/249; 362/226; 362/251; 362/391; 362/806; 439/419; 439/425

[58] Field of Search ..... 362/226, 227, 238, 239, 362/249, 250, 251, 252, 806, 396, 391; 439/602, 611, 617, 419, 425

[56] References Cited

U.S. PATENT DOCUMENTS

| | | | |
|---|---|---|---|
| 2,506,620 | 5/1950 | Sundt | 362/249 X |
| 4,631,650 | 12/1986 | Ahroni | 362/249 |
| 4,777,573 | 10/1988 | Liao | 362/249 |
| 4,779,177 | 10/1988 | Ahroni | 362/236 |
| 4,807,098 | 2/1989 | Ahroni | 362/249 |
| 4,899,266 | 2/1990 | Ahroni | 362/252 X |
| 5,051,877 | 9/1991 | Liao | 362/249 |

*Primary Examiner*—Stephen F. Husar
*Attorney, Agent, or Firm*—Seed and Berry

[57] ABSTRACT

Miniature light units with push-in bulb assemblies are mounted on a multi-wire cord in an arrangement providing a "chaser" set. The push-in bulb assemblies plug into the socket of socket housings which provide wireways for the cord and multiple guideways for pairs of push-in contact elements. The contact elements bridge cutouts in the cord wires provided in a predetermined pattern, there being one cutout in each light unit. The bulb assemblies have lead wires extending across opposite side faces so as to engage the contact elements regardless of which of the guideways is occupied by the contact elements. Jaws at the ends of the wireways clamp the cord against movement relative to the light units when the socket housings are assembled.

24 Claims, 4 Drawing Sheets

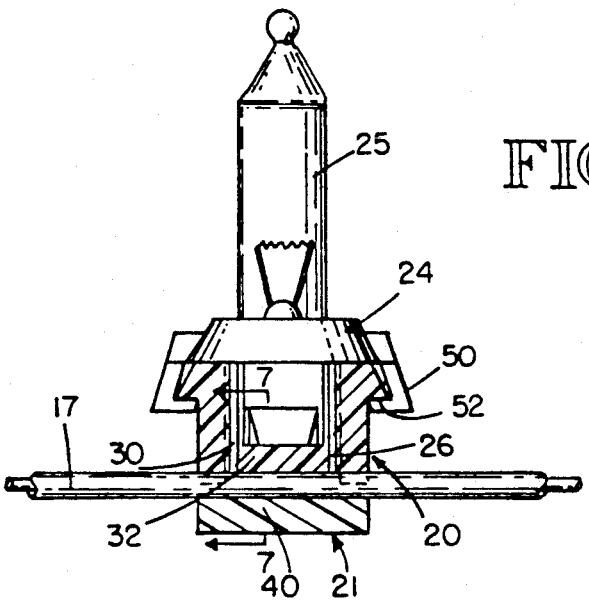
FIG. 3
FIG. 4
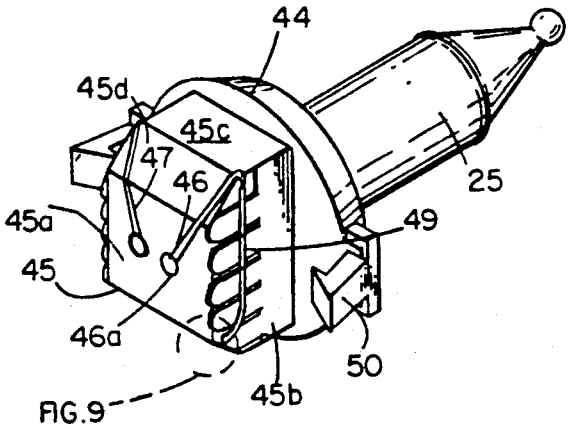
FIG. 5
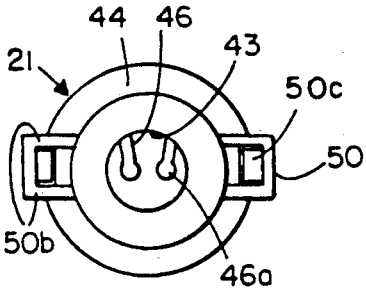
FIG. 6
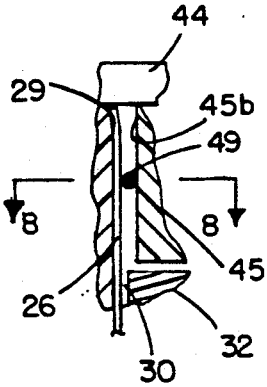
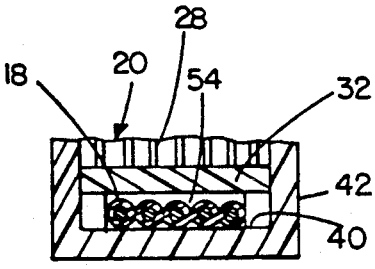
FIG. 7

FIG.12
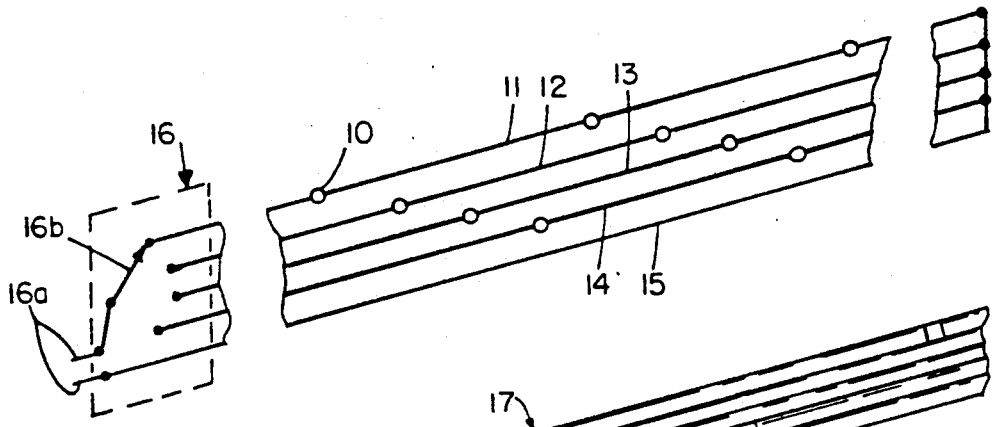
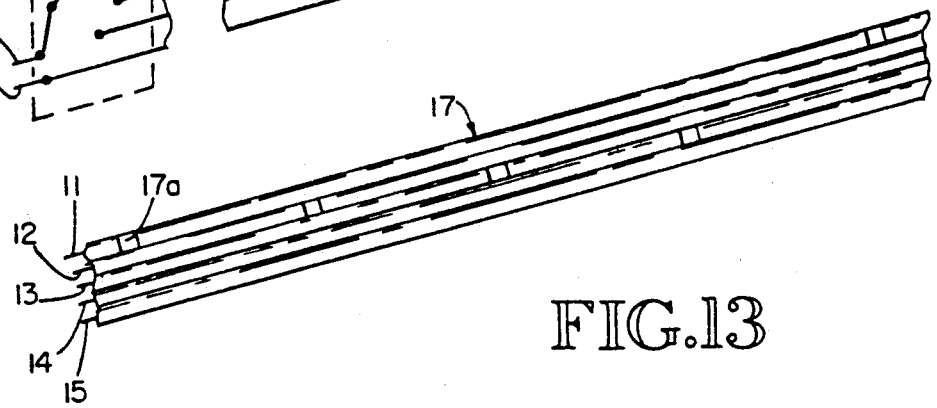
FIG.13

LIGHT UNIT FOR DECORATIVE MINIATURE LIGHT SETS

REFERENCE TO RELATED APPLICATIONS

This application is a continuation-in-part of my copending application Ser. No. 07/461,489, filed Jan. 5, 1990, now abandoned; which is a continuation-in-part of U.S. Pat. No. 4,899,266; which is a continuation-in-part of U.S. Pat. No. 4,807,098; which is a continuation-in-part of U.S. Pat. No. 4,779,177; which is a continuation-in-part of U.S. Pat. No. 4,631,650.

1. Technical Field

The present invention relates to light units with push-in type of bulb assemblies, used in miniature decorative light sets, such as "chaser" sets, for example, in which multiple parallel series of bulbs are lit momentarily in sequential order.

2. Background of the Invention

In the past, chaser sets have comprised multiple-series sets of light units, each having a cord with cord segments extending between light units. Each cord had a single wire within each segment, and each light unit had a pair of bulb leads engaging a pair of contact elements which were connected within the light unit to the ends of two of the adjoining wire segments. The light units in each series set were staggered relative to the light units in the other series sets making up the chaser set. The cords for the series sets plus an extra cord ("return cord") normally have been wound together in an arrangement wherein all of the cords at each light unit, except the cord which is directly connected to the light unit, bypass the light unit. The wound cords have their wires connected together at one end and are connected at their other end to a controller unit adapted to plug into a standard electrical wall outlet. The controller unit has a switching assembly functioning to rapidly sequentially connect the series sets of light sets to the power supply.

A typical chaser set has had four series sets of lights, thus requiring that there be five parallel cords wound together. In such an arrangement, the bulbs do not have any particular directional orientation; and thus it is difficult to mount such a set around a window, for example, so that all of the bulbs along each side of the window project in the same direction. Furthermore, the wound-together wires extending between the lights detract

SUMMARY OF THE INVENTION

The present invention makes it possible to consolidate all of the cords in a chaser set into a single cord containing all of the wires in side-by-side relation separated by insulation. This cord may be laid flat on a mounting surface and results in all of the bulbs projecting in the same direction, namely, perpendicular to the mounting surface. Improved light units of the present invention present wireways through which the multiwire cord passes. In each wireway, one of the wires in the cord has a cutout, and the resulting interruption in the circuit is completed by a pair of push-in contact elements which contact leads from the respective bulb and project through the cord insulation into the two wire segments adjoining the cutout.

The two contact elements in each light unit are guided into proper position within a set of side-by-side guideways exposed to a socket cavity within the housing of the light unit. Each of the light units on a given wire has its contact elements in the same guideways, there being at least as many guideways as wires. In fact, so that the light units are reversible, it is preferred to have an additional guideway extending toward the return wire, which preferably is one of the two outer wires in the cord.

The improved light units utilize a bulb assembly having a plug-in bulb holder which has the two leads from the bulb extending partway around opposite sides sufficiently to be exposed to all of the guideways in the socket housing. By this arrangement, contact will be made between the lead wires and the contact elements regardless of which of the guideways are occupied by the contact elements. As a further improvement, the bulb holders have snap-on fingers which grip the socket housing of the light units to positively retain the bulb units so that they will not be dislodged, for example, by the wind if used out of doors.

The socket housing can be molded directly onto the cord, or the housing can be a two-piece structure which clamps together over the cord. In the latter instance, the present invention provides an unusually compact arrangement in which finger elements on a base member clamp to a socket member in positions entirely within the socket member.

BRIEF DESCRIPTION OF THE DRAWINGS

In the drawings:

FIG. 3 is a longitudinal sectional view through one of the light units, taken as indicated by line 3—3 in FIG. 1;

FIG. 4 is a bottom perspective view of one of the bulb assemblies;

FIG. 5 is a top plan view of one of the bulb holders before insertion of a bulb;

FIG. 6 is a detail enlarged vertical sectional view taken similarly to FIG. 3 and showing a lead wire from the bulb making contact with one of the contact elements;

FIG. 7 is a fragmentary, vertical sectional view, to an enlarged scale, taken as indicated by line 7—7 in FIG. 3;

FIG. 12 is a wiring diagram for the light set; and

FIG. 13 is a fragmentary plan view of a portion of the cord illustrating the pattern of cutouts in the cord wires within the wireways of the light units when they are mounted on the cord.

DETAILED DESCRIPTION OF THE INVENTION

Figures 1, 2:
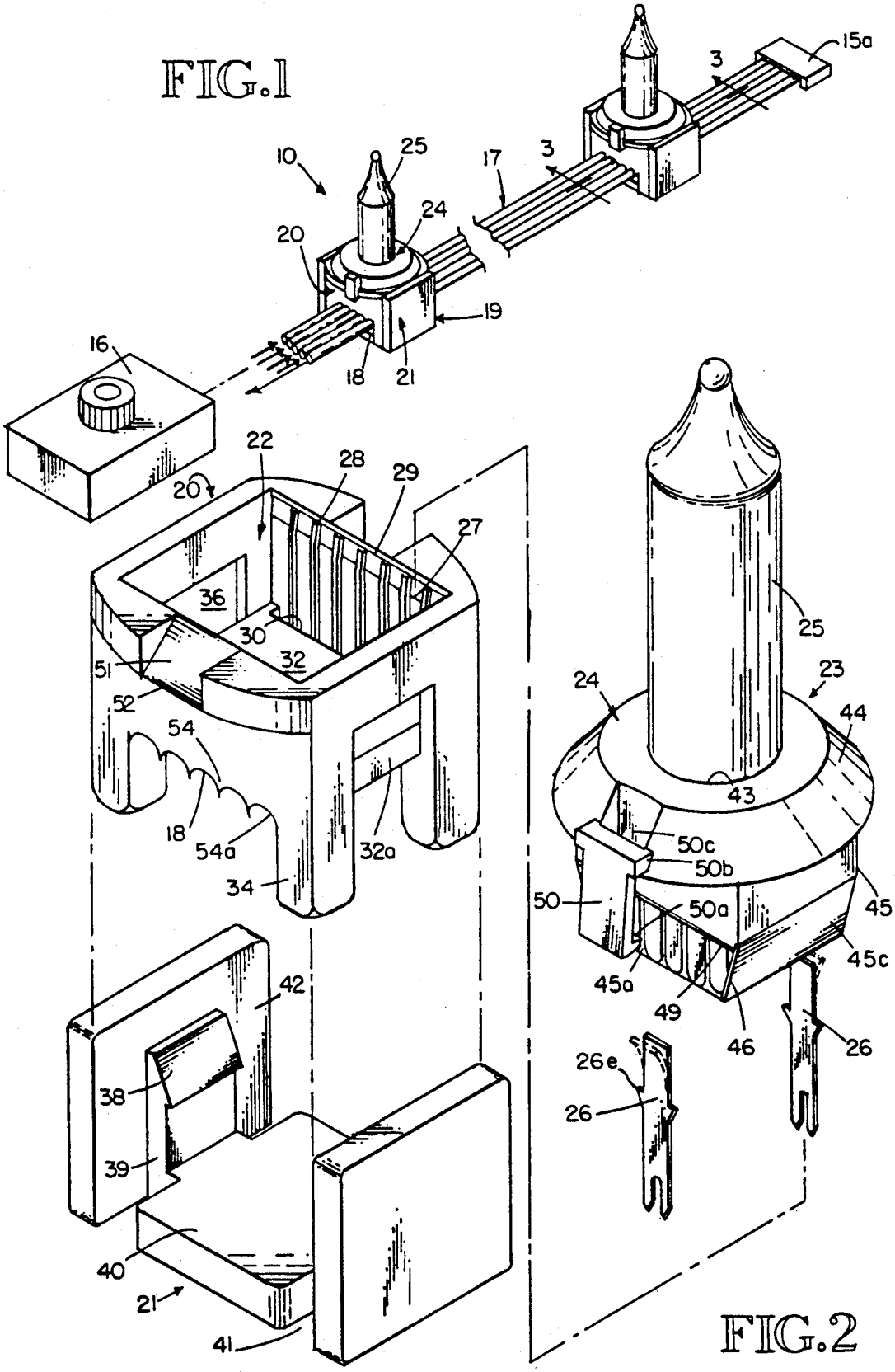
FIG. 1 is a fragmentary perspective view of a light set according to the present invention.
FIG. 2 is an exploded perspective view of the parts for one of the light units in the set, but with the bulb and bulb holder already assembled.

For purpose of example, the invention has been illustrated as applied to a chaser set having four series of light units 10 on four respective segmentalized wires 11-14. These wires and a return wire 15 extend from a controller 16 and are connected together at their outer end within a suitable insulated shield 15*a*. The controller 16 has a pair of projecting conductor blades 16*a* for fitting into a standard electrical wall outlet or for use with an extension cord. One of the blades 16*a* is connected to the return wire 15 and the other blade is connected to a switching mechanism 16*b* provided by the controller 16. This switching mechanism alternately completes a circuit to the wires 11-14.

The wires 11-15 are arranged in side-by-side spaced relation as part of a single cord 17 having insulation 17*a* surrounding and separating the wires. The cord 17 passes through wireways 18 in the light units 10, and the wires 11-14 are segmentalized by cutouts 17*b* in the cord within the wireways of the light units 10. Each cutout 17*b* extends through only one of the wires and the related external insulation, namely, the wire servicing the light unit with the wireway containing the cutout. The resulting gap between the wire segments on each side of the cutout is bridged via a pair of contact elements and the leads from the filament of the bulb in the light unit in a manner to be described.

In the preferred embodiment, the light units 10 include a two-piece socket housing 19 consisting of a socket unit 20 and a generally U-shaped base unit 21 which have a snap interfit and provide therebetween the wireway 18 for passage of the cord 17. The socket unit 20 provides a generally rectangular socket cavity 22 for receiving a push-in bulb assembly 23 having a bulb holder 24 in which a bulb 25 is mounted. Each light unit 10 is completed by a pair of elongated push-in contact elements 26 at opposite sides of the socket cavity 22. These contact elements 26 fit into selected corresponding stations of matching opposed sets of stations, which preferably take the form of guideways 27 defined by parallel spaced ribs 28 on opposed socket faces 29. These ribs 28 continue from the mouth of the socket cavity 22 through base slots 30 which extend through a base wall 32, at opposite side edges thereof, into transverse communication with the wireway 18 so that the planes of the contact elements 26 will be crosswise of the cord.

Projecting from the socket unit 20 adjacent the ends of the base slots 30 are four legs 34. The ends 32*a* of the base wall 32 are recessed from the legs 34, and the opposite side walls of the socket unit have openings 36 above the base wall 32 for entry of locking fingers 38 on the base unit. These locking fingers 38 project inwardly from opposed side flanges 39 sized to fit between respective pairs of the legs 34. The base unit 21 has a base wall 40 with four corner cutouts 41 to receive the legs 34. Surrounding three sides of the border of the side flanges 39, there is provided a cover lip 42 extending from each side flange 39.

Figure 9:
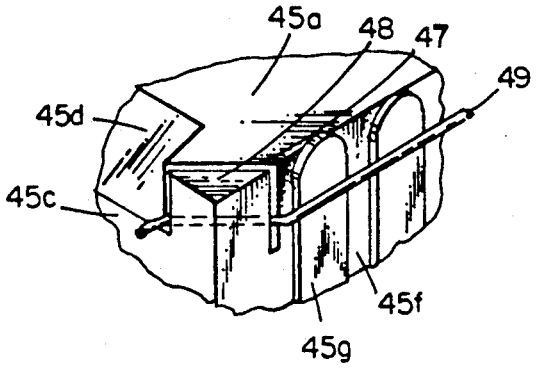
FIG. 9 is a detailed perspective view of a bottom corner portion of a bulb assembly before heat sealing, taken as indicated in FIG. 4.

The bulb holder 24 has a central socket 43 to receive the bulb 25 and has an annular rim 44 surmounting a generally rectangular plug 45 containing the socket 43. This plug 45 has a bottom wall 45*a*, opposite exterior side faces 45*b* between end faces 45*c*, and sloped, trapezoidal walls 45*d*, 45*e* between the bottom 45*a* and the end faces 45*c*. A pair of diverging slot 46-46 extend through the bottom wall 45*a*, and continue upwardly through the sloped walls 45*d* to positions adjacent the ends of the side faces 45*b*. The slots 46 preferably have a central inner end enlargement 46a to guide exiting of the bulb leads, 48, 49 from the holder socket 43 during assembly. Directing attention to FIG. 9, it will be noted that the trapezoidal wall 45*e* does not extend endwise to the side faces 45*b*, thereby leaving bottom corner portions. These corner portions each have a diagonal keeper slot 47 defining a respective corner element 48.

Figure 10:
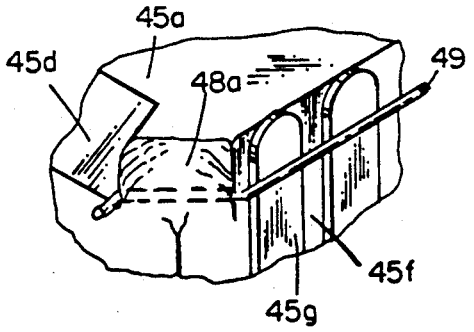
FIG. 10 is a view, like FIG. 9, after heat sealing at the corner of the bulb holder.

During mounting of a bulb 25 in a holder 24, the two bulb leads 49 are threaded through the central end enlargements 46*a* of the slots 46 and the bulb is seated in the holder socket 43. The leads 49 are then pulled along the slots 46 to the outer ends thereof, whereupon the leads are pulled across the side faces 45*b* at opposite sides of the plug 45. Then the free end portions of the leads are inserted in the keeper slots 47 to anchor the leads. As indicated in FIG. 10 at 48*a*, this anchoring may be augmented by heat sealing the corner elements 48 to the adjoining portions of the holder 24 to close the keeper slots 46.

Figure 8:
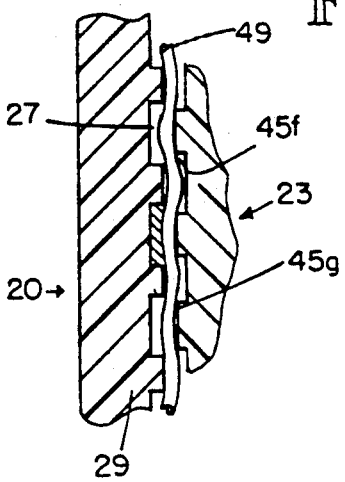
FIG. 8 is a fragmentary, horizontal sectional view, to an enlarged scale, taken as indicated by line 8—8 in FIG. 6.

Preferably, the opposed inner faces 29 of the socket cavity 22 containing the guide ribs 28 are sloped outwardly away from one another at the mouth portion of the cavity to provide initial clearance for passage of the bulb leads 49 into the socket cavity 22 when the bulb holder 24 is being pushed into the cavity 22. During insertion of the bulb holder, the bulb leads 49 are pinched between the side faces 45*a* of the plug portion 45 of the bulb holder 24 and the two contact elements 26 at opposite sides of the socket cavity 22. This is true regardless of which of the guideways 27 are occupied by the contact elements 26 because the bulb leads extend across all of the guideways 27. As shown in FIG. 8, it is preferred to provide the side faces 45*a* with grooves 45*f* arranged to be directly opposite the guide ribs 28 so that the lands 45*g* between the grooves 45*f* will press the bulb leads 49 tightly against the contact elements 26.

Figure 11:
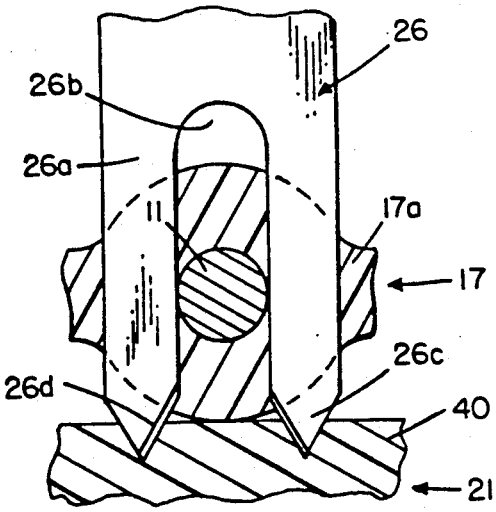
FIG. 11 is a detailed, vertical sectional view showing a contact element in wire-contacting position within the multiwire cord.

The contact elements 26 have a width slightly less than that of the guideways 27 and are bifurcated at their lead-in ends to provide a pair of prongs 26*a* which are separated by a slot 26*b* and have V-shaped insulation shearing end portions 26*c* sharpened along their opposed inner edges 26*d*. As indicated in FIG. 11, the prongs 26*a* are designed to straddle and engage one of the wires 11-14 when the prongs pierce the insulation 17*a* of the cord 17 as the contact element is pushed along one of the guideways 27 into the wireway 18 sufficiently for the tips of the prongs to bite into the plastic of the base wall 40 of the base unit 21. Preferably, the contact elements 26 are provided with one or more pairs of hold-in barbs 26*e* shaped to bite into the adjoining ribs 28. The base slots 30 in the socket housing 20 are slightly thicker than the thickness of the contact elements 26, and the sides of the base slots 30 at the ends of the base wall 32 may be tapered to assist in guiding the prongs 26*a* into the base slots.

The bulb holder 24 preferably is provided with a pair of locking fingers 50 which project over the side faces 45*b* from the annular rim 44 and have in-turned locking elements 50*a* which are tapered at their bottom sides. These locking fingers are arranged to spring apart as they ride over sloped entry ramps 51 at the outside of the rim of the mouth of the socket cavity 22 in the socket housing 20 when the bulb holder is pushed into the cavity 22. Then the locking fingers 50 spring inwardly at the outer ends of the ramps 51 so that their locking elements 50*a* engage stop shoulders 52 beneath the ramps. The locking fingers 50 have a pair of fork arms 50*b* at their root end which connect to the rim 44 of the bulb holder 45 and are separated by an opening 52 which overlies the respective locking element 50*a*. This arrangement makes it possible to injection mold the locking fingers as an integral part of the bulb holder 45.

At both ends of the wireway 18, the socket unit 20 preferably has side wall extensions which depend as jaws 54 to oppose the base wall 40 of the base unit 21. Each jaw 54 preferably is serrated to form teeth having rounded gullets 54*a* which collectively approximate the transverse shape of the top face of the cord 17. The gullets 54*a* are at a level below the level of the bottom face of the base wall 32 so that the insulation 17*a* of the cord 17 will be compressed between the jaws 54 and the base wall 40 of the base unit sufficiently to hold the respective socket unit 20 against movement relative to the cord 17 and to hold the wires 11–14 against endwise movement relative to the surrounding insulation 17*a* within the wireway 18.

During assembly of the chaser set, the cord 17 is fed to an assembly station. On the way to this station, the cord is punched to provide the proper pattern of cutouts 17*b*. This pattern presents regularly spaced cutout intervals in each wire 11–14 with the cutouts in wires 12, 13, and 14 being advanced beyond those in wire 11 by one-fourth, one-half, and three-fourths, respectively, of the spacing interval of the light units 10. Hence, the cord 17 has the light units therealong spaced apart one-fourth of the distance that the light units are spaced apart on each of the wires 11–14.

When a cutout 17*b* reaches the assembly station, a socket housing 20 and base unit 21 are fed from opposite sides of the travel path of the cord into alignment with the cutout and pressed toward one another so that the four legs 34 of the socket and the locking fingers 38 of the base unit straddle the cord 17, whereupon the locking fingers 38 engage the ends 32*a* of the base wall 32 and spring through the openings 36 into engagement with the upper surface of the base wall 32 within the bottom of the socket cavity 22. This clamps the cord 17 between the jaws 54 of the socket housing 20 and the base wall 40 of the base unit 21 and locks the base unit 21 to the socket housing 20, with the cover lips 42 overlapping the end faces of the housing and the cutout 17*b* centered in the wireway 18 formed by the base unit 21 and socket housing 20. Then a pair of the contact elements 26 are pushed into the appropriate guideways 27 by a sequencing feeder until the shearing end portions 26*c* of their prongs 26*a* pierce through the cord insulation 17*a* and lodge in the base wall 40 to position the cord wire which is opposite such guideways within the prong slots 26*b*. The upper end portions of the contact elements 26 are then bent outwardly in accordance with the outward slope of the mouth-end portion of the faces 29 of the socket cavity 22. Bulb assemblies 23 can then be pushed into the socket cavity 22 at a subsequent station.

In the illustrated example, there are five guideways 2 in each set of stations for the contact elements 26. However, only four of these are ever occupied by a contact element 26, because one of the outer wires of the five side-by-side wires in the cord is the "return" wire and hence is never engaged by a contact element. The purpose of providing the extra guideway is to have the socket housings reversible so that it is unnecessary during assembly to orient the socket housings 19 in only one way with respect to the cord 17.

It will be understood from U.S. Pat. No. 4,899,266 that, as an alternative, the socket housing 20 and base unit 21 can be molded in an injection molding machine as a single unit around the cord 17 and that the cutouts can be preliminarily formed in the injection molding machine or before the cord 17 passes into the machine.

The socket housing 20 and base unit 21 can be individually injection molded as miniature plastic parts so that, when assembled, the resulting unit is only about one-half of an inch in length transversely of the wireway 18 and only about three-eighths of an inch in width along the wireway and in height.

The invention is also applicable, for example, to series-parallel miniature light sets of the type disclosed in U.S. Pat. Nos. 4,899,266 and 4,779,177 wherein a cord with three side-by-side insulated wires passes through wireways in light units having push-in bulb holders containing bulbs with leads pinched between the bulb holders and contact elements in the light units which engage one of the wires in the cord at opposite sides of a cutout in the wire. When the present invention is applied to such a series-parallel set with three wires in the cord, the number of guideways for the contact elements may be reduced to three.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A light assembly, comprising:

a housing unit providing a transverse wireway at one end thereof and a socket with an entry at the opposite end thereof, said housing unit having respective sets of side-by-side stations at two opposite sides of said socket for receiving contact elements, each station in each set having a corresponding station in the other set which is located directly opposite thereto, said stations continuing from said socket to said wireway, said wireway being shaped to receive insulated side-by-side wires extending through said wireway, and having a respective wire for each two corresponding stations in said sets, one of said wires having an interruption within said wireway;

a pair of elongated contact elements occupying two corresponding stations in said sets and projecting into said wireway for engagement with said one wire at opposite ends of said interruption; and a push-in bulb unit seated in said socket and presenting two light bulb leads at opposite sides thereof, said leads passing across the stations of a respective one of said sets so as to engage a respective said contact element regardless of which station it occupies.

2. A light unit according to claim 1 in which each of said stations has guide ribs at opposite sides so that each station presents a guideway for a said contact element.

3. A light unit according to claim 2 in which said contact elements have retaining barbs engaging adjoining of said guide ribs.

4. A light unit according to claim 1 in which each of said sets have at least three stations.

5. A light unit according to claim 1 in which said socket is enlarged sufficiently at said entry to permit said bulb unit to be inserted in said socket with said leads exposed and positioned to pass across the stations of a respective one of said sets when said bulb assembly is seated in said socket.

6. A light unit according to claim 1 in which said bulb unit comprises a bulb holder and a bulb in said bulb holder, said leads extending from said bulb and passing through said bulb holder into positions passing partway around the bulb holder at opposite sides thereof.

7. A light unit according to claim 6 in which said opposite sides of said bulb holder have generally planar faces crossed by said leads.

8. A light set according to claim 1 in which means is operatively associated with said housing and bulb assembly for clamping them together responsive to pushing of said bulb assembly into said socket.

9. A light set according to claim 1 in which said housing has a base unit and a socket housing unit which are snap-fitted together within the confines of said socket housing unit at opposite sides thereof and collectively provide said wireway.

10. A light unit according to claim 9 in which said socket housing unit has wire clamping jaws at the ends of said wireway.

11. A light assembly, comprising:

a housing providing a wireway at one end and a socket at the opposite end, said housing having a divider wall separating said wireway and socket, said divider wall having a pair of slots therethrough connecting said socket to said wireway, and said socket having a pair of guide faces merging with said slots;

a pair of elongated contact elements engaging said guide faces and extending through said slots into said wireway, said contact elements being narrower than said guide faces; and a plug-in light unit seated in said socket and having a bulb with two leads engaging respective of said contact elements across the full width thereof, said leads also extending across portions of said guide faces not engaged by said contact elements.

12. A light assembly in accordance with claim 11 in which said light unit comprises:

a plug-in bulb holder having a socket open at one end thereof and a base at the opposite end thereof to which said socket extends, said bulb holder having a pair of side walls at opposite sides of said socket merging with said base, said pair of side walls being laterally separated by additional side walls merging with said base and being positioned opposite said guide faces; and a lamp seated in said socket and having a pair of lead wires passing from said lamp through openings in said bulb holder and extending laterally across respective of said pair of side walls at the outside of said bulb holder to outer end portions of said lead wires, said lead wires being pinched between said guide faces and side walls.

13. A plug-in bulb unit according to claim 12 in which said outer end portions of said lead wires are anchored to said bulb holder.

14. A plug-in bulb unit for a light assembly, comprising:

a plug-in bulb holder having a socket open at one end thereof and a base at the opposite end thereof to which said socket extends, said bulb holder having a pair of side walls at opposite sides of said socket merging with said base, said pair of side walls being laterally separated by end walls merging with said base; and a light bulb seated in said socket and having a pair of lead wires passing from said bulb through openings in said bulb holder and extending laterally across respective ones of said pair of side walls at the outside of said bulb holder to outer end portions of said lead wires.

15. A plug-in bulb unit according to claim 14 in which said outer end portions of said lead wires are anchored to said bulb holder.

16. A plug-in bulb unit according to claim 14 in which said outer end portions of said lead wires occupy slots in said bulb holder.

17. A plug-in bulb unit according to claim 16 in which said bulb holder portions on opposite sides of said slots are heat sealed together to anchor said outer end portions of said lead wires.

18. A plug-in bulb unit according to claim 14 in which said openings in said bulb holder comprise two slots extending from a bottom end located at a central part of said base to an upper end located partway up one of said end walls, said wire leads passing outwardly through said slots adjacent said upper end thereof, and then extending across said side walls to the other of said end walls to said outer end portions.

19. A plug-in bulb unit according to claim 18 in which said outer end portions are anchored to said bulb holder adjacent said other end wall.

20. A light assembly, comprising:

a socket housing unit and a base unit snap-fitted collectively providing a wireway therebetween;

two jaw means restricting opposite end portions of said wireway for clamping an insulated cord with multiple side-by-side wires passing through said wireway when said socket housing unit and base unit are being snapped together;

two contact elements projecting by insulation piercing end portions from said socket housing unit into said wireway between said two jaw means for engaging one of said wires in said cord; and a plug-in bulb assembly in said socket housing unit having a light bulb with wire leads engaging said contact elements.

21. A light assembly according to claim 20 in which said jaw means includes serrated jaws projecting integrally from one of said units into the wireway.

22. A light assembly according to claim 20 in which each of said contact elements is bifurcated to provide prongs separated by a wire receiving slot, said prongs providing said insulation piercing end portions.

23. A light assembly according to claim 22 in which said end portions are V-shaped and sharpened.

24. In combination with a light assembly according to claim 20, an insulated multi-wire cord passing through said wireway and having one of its wires interrupted between said contact elements, said cord being sufficiently clamped by said jaw means when said base unit and socket housing unit are snapped together that said interrupted wire is prevented from moving in said wireway relative to said units responsive to flexing of said cord externally of said wireway.

* * * * *

UNITED STATES PATENT AND TRADEMARK OFFICE

CERTIFICATE OF CORRECTION

PATENT NO. : 5,109,324

DATED : April 28, 1992

INVENTOR(S) : Joseph M. Ahroni

It is certified that error appears in the above-identified patent and that said Letters Patent is hereby corrected as shown below:

In column 8, claim 20, line 31, after "snap-fitted" please insert -- together and --.

Signed and Sealed this

Twenty-ninth Day of June, 1993

*Attest:*

Michael K. Kirk

MICHAEL K. KIRK

*Attesting Officer*

*Acting Commissioner of Patents and Trademarks*